United States Patent [19]

Mizoule et al.

[11] 4,277,911

[45] Jul. 14, 1981

[54] CHANGING THE COLOR OF A DOLL'S EYES

[76] Inventors: Henri Mizoule, 2 bis rue Lecointre, Sevres, France, 92310; William Gardel, 75, rue de Versailles, Ville d'Avray, France, 92410

[21] Appl. No.: 99,584

[22] Filed: Dec. 3, 1979

[30] Foreign Application Priority Data

Dec. 8, 1978 [FR] France ..... 78 34679

[51] Int. Cl.[3] ..... A63H 13/00

[52] U.S. Cl. ..... 46/135 R

[58] Field of Search ..... 46/135 R, 153

[56] References Cited

U.S. PATENT DOCUMENTS

| | | | |
|---|---|---|---|
| 2,208,219 | 8/1937 | Maibaum | 46/135 R |
| 3,757,465 | 9/1973 | Barlow | 46/135 R |

*Primary Examiner*—F. Barry Shay

*Attorney, Agent, or Firm*—Fulwider, Patton, Rieber, Lee & Utecht

[57] ABSTRACT

A device permitting to change the color of the iris in a doll's eyes.

In said device, the eye is constituted by a transparent iris provided in its center with a dark and opaque area forming the pupil, and behind said iris is mounted a cylinder comprising reflecting colored screens which are brought behind the iris by rotating the said cylinder.

7 Claims, 6 Drawing Figures

FIG. 1
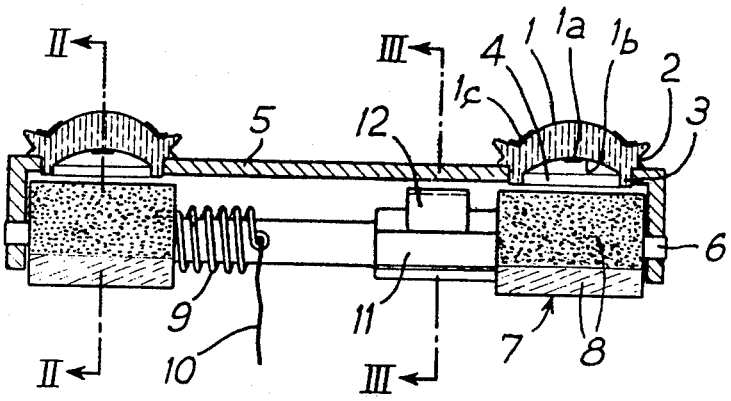
FIG. 4
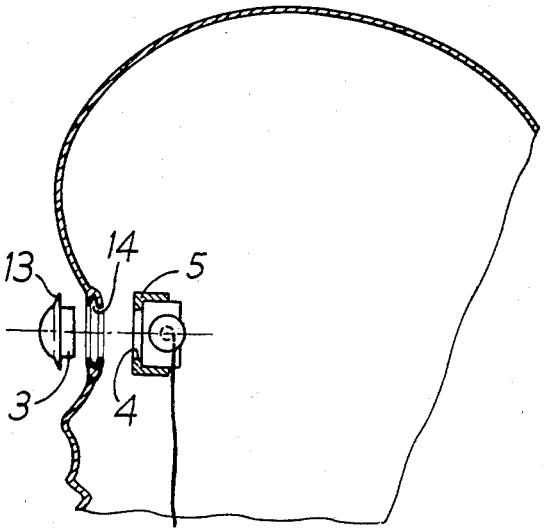
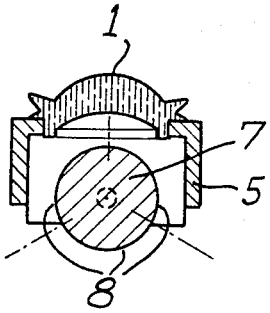
FIG. 2
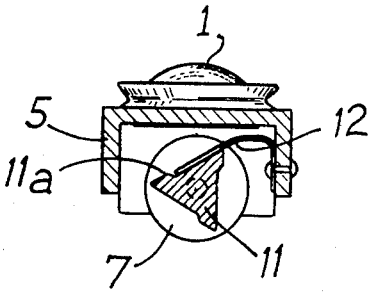
FIG. 3

FIG. 5
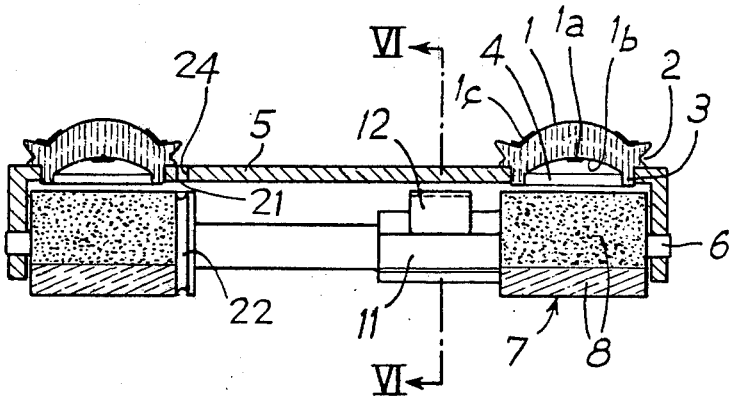
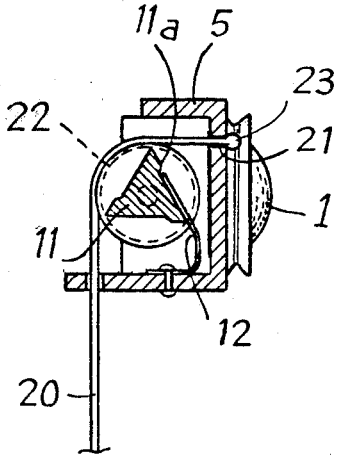
FIG. 6

CHANGING THE COLOR OF A DOLL'S EYES

The invention relates to a device permitting changing the color of the iris in a doll's eyes.

Such eye color changing devices have already been proposed. They consist of a cylinder on which are drawn eyes of different colors, which are brought opposite the opening of the eye in the doll's head by rotating the cylinder. In such devices, the moving part is accessible from the outside and the eye is not integral with the doll's head, hence providing a rather unnatural appearance.

It is the object of the invention to overcome this disadvantage by preventing the child from jamming the mechanism which is entirely internal to the doll's head and by giving the eye a most attractive natural appearance.

The invention therefore proposes a device for changing the color of the iris in a doll's eye, wherein the eye comprises a transparent iris behind which is placed a colored screen which shows the iris to be of the same color as the screen said latter being mounted on a movable member on which are also mounted other screens of different colors, each one of which screen can be brought behind the iris by moving the said movable member.

The invention will be more readily understood on reading the following description with reference to the accompanying drawings in which:

FIG. 1 is an axial cross-section of the device according to the invention,

FIG. 2 is a cross-section along line II—II of FIG. 1,

FIG. 3 is a cross-section along line III—III of FIG. 1,

FIG. 4 is a view showing the device according to the invention fitted in the opening of the eye in the doll's head.

FIG. 5 is a view similar to FIG. 1, showing another embodiment of the device according to the invention;

FIG. 6 is a cross-section along line VI—VI of FIG. 5.

According to the invention, the device comprises a transparent frontal spherical eyeball segment 1 provided in its center with a dark and opaque portion 1*a* forming the pupil and surrounded by a transparent annular portion 1*b*, which is colorless and through which may be viewed a simulated iris; etchings on the inner face of the eye ball reproduce the natural appearance of the iris, which iris is itself surrounded by a white opaque portion 1*c* representing the sclera.

On its periphery, the eyeball comprises a groove 2, into which fits the edge of the opening of the doll's head in order to hold the said eye ball in position in the opening.

At the back of said eyeball and on the inside of the doll's head, said ball is provided with a cylindrical projection 3 onto which fits the actual device for changing the color of the iris, by insertion of the said projection in a corresponding opening 4 provided in the support 5 of the color-changing device.

Said support 5 which is provided with openings 4 corresponding to two eyeballs, supports a rotating axle 6 on which are mounted two cylinders 7 which rotate with the said axis behind the two transparent irises.

Said cylinder 7 comprises three reflecting screens 8 of different colors, each screen by coming into position behind the iris giving the latter a colored aspect which corresponds to the color of the screen.

To rotate the axle 6, said axle is provided with a spring 9 wound around the axle and secured thereto by one of its ends, whereas the other end of the spring is tied to a cord 10 issuing from inside of the doll through any kind of opening and which is pulled in order to make the axle 6 rotate.

To position the screen 8 accurately behind the iris, a cam 11 of triangular cross-section is mounted on said axle, which cam is in contact with a spring blade 12 secured to the support 5 and resting one of the faces of said cam, a projection 11*a* of each face coming into contact with the end of the blade and playing the part of no-return abutment so as to prevent the axle from rotating in the opposite direction.

The invention is not limited to the embodiments shown and described hereabove, and various modifications may be made thereto without departing from its scope.

For example, the cylinder 7 may be replaced by a prism of regular plygonal cross-section, each face of which comprises a reflecting screen. In the same way, the spring 9 and cord 10 assembly may be replaced by an elastic.

The screens could also be just colored, but the fact that they are reflecting gives more brilliancy to the iris.

The iris such as shown in FIG. 4, can comprise a peripheral projection 13 which is inserted in a groove 14 of the eye opening instead of having a groove 2 inside which engages the edge of such opening.

In the embodiment shown in FIG. 4, the inner edges limiting the groove is nipped at assembling time between the projection 13 of the iris and the support 5, when the cylindrical projection 3 is fitted in the opening 4 of the support.

In the embodiment of FIGS. 5 and 6, the rotation of the assembly 6, 7 is controlled by pulling on one end of an elastic 20, the other end of which is tied to the support 5 in one point 21 situated opposite a pulley 22 provided on the said rotating assembly 6, 7 at one end of a cylinder 7. The elastic 20 is tied in the point 21 by way of a knot 23 for example, which knot is made at the end of the elastic 20, said latter being threaded through a hole 24 provided in the support 5, which hole is situated in point 21. The elastic passes over part of the periphery of the pulley 22, and thus, by a pulling action, followed by a slackening of the elastic 20, the assembly 6, 7 is caused to advance one notch.

What is claimed is:

1. In combination with a doll's head formed with eye openings, apparatus for changing the color of the eyes in said head comprising:

a frontal spherical segment of a simulated eyeball mounted within each of said eye openings, said eyeballs each having portions of an eye represented thereon and being of a transparent material at the portions corresponding to the irises;

screen members associated with said segments, each said screen member having a plurality of different colored areas which are selectively positionable behind its associated segment whereby said areas are visible through said iris portions to simulate irises of different colors; and positioning means supported by said doll's head and operatively associated with said screen members to selectively position and retain one of said areas behind each of said segments.

2. Apparatus as set forth in claim 1, wherein each said segment is provided at its center with a dark and opaque portion simulating the pupil of an eye.

3. Apparatus as set forth in claim 1, wherein the periphery of each said segment is formed with a peripheral groove which fits within said eye openings.

4. Apparatus as set forth in claim 1, wherein said screen member includes rotatable cylinder means whereon appear said different colored areas.

5. Apparatus as set forth in claim 1, wherein said colored areas are of reflecting material.

6. Apparatus as set forth in claim 4, wherein said cylinder means is supported by an axle and said positioning means include a multi-sided cam carried by said axle and engaged by a spring to releasably retain said axle in different positions wherein said areas are visible through said segments.

7. Apparatus as set forth in claim 6, wherein each said segment is provided at its center with a dark and opaque portion simulating the pupil of an eye.

* * * * *